US006768476B2

(12) United States Patent
Lilly et al.

(10) Patent No.: US 6,768,476 B2
(45) Date of Patent: Jul. 27, 2004

(54) CAPACITIVELY-LOADED BENT-WIRE MONOPOLE ON AN ARTIFICIAL MAGNETIC CONDUCTOR

(75) Inventors: James D. Lilly, Silver Spring, MD (US); William E. McKinzie, III, Fulton, MD (US); David T. Auckland, Silver Spring, MD (US); Andrew Humen, Jr., Crofton, MD (US)

(73) Assignee: Etenna Corporation, Laurel, MD (US)

( * ) Notice: Subject to any disclaimer, the term of this patent is extended or adjusted under 35 U.S.C. 154(b) by 0 days.

(21) Appl. No.: 10/310,714

(22) Filed: Dec. 5, 2002

(65) Prior Publication Data

US 2003/0197658 A1 Oct. 23, 2003

Related U.S. Application Data

(60) Provisional application No. 60/338,431, filed on Dec. 5, 2001.

(51) Int. Cl.[7] ..... H01Q 15/02

(52) U.S. Cl. ..... 343/909; 343/700 MS; 343/752

(58) Field of Search ..... 343/909, 910, 343/700 MS, 745, 752, 756

(56) References Cited

U.S. PATENT DOCUMENTS

| | | | | |
|---|---|---|---|---|
| 5,208,603 | A | 5/1993 | Yee | 343/909 |
| 5,917,458 | A | 6/1999 | Ho et al. | 343/909 |
| 6,426,722 | B1 * | 7/2002 | Sievenpiper et al. | 343/700 MS |
| 6,483,480 | B1 | 11/2002 | Sievenpiper et al. | 343/909 |
| 6,538,621 | B1 * | 3/2003 | Sievenpiper et al. | 343/909 |
| 6,545,647 | B1 * | 4/2003 | Sievenpiper et al. | 343/795 |

* cited by examiner

*Primary Examiner*—Hoang V. Nguyen
(74) *Attorney, Agent, or Firm*—Brinks Hofer Gilson & Lione

(57) ABSTRACT

An antenna consisting of a thin strip bent-wire monopole disposed on an artificial magnetic conductor (AMC) is loaded at the end opposite to the feed point with a distributed or lumped capacitance to achieve an electrically small antenna for use in handheld wireless devices. The capacitive load reduces the length of the antenna to smaller than one-quarter of a wavelength at a given frequency of operation without suffering a substantial loss of efficiency. This results in an easier integration into portable devices, greater radiation efficiency than other loaded antenna approaches and longer battery life in portable devices, and lower cost than use of a chip inductor.

54 Claims, 11 Drawing Sheets

400
402
404
406

420
422
424
426
428

440
442
444
446
448
450

460
462
464
466
468
470

480
482
484
486

CAPACITIVELY-LOADED BENT-WIRE MONOPOLE ON AN ARTIFICIAL MAGNETIC CONDUCTOR

CROSS REFERENCE TO RELATED APPLICATIONS

This application is a non-provisional application claiming priority to provisional application serial No. 60/338,431, filed Dec. 5, 2001.

BACKGROUND

Due to the constant demand for improved efficiency of antennas and increased battery lifetime in portable communication systems high-impedance surfaces have been the subject of increasing research. High-impedance surfaces have a number of properties that make them important for applications in communication equipment. The high-impedance surface is a lossless, reactive surface, whose equivalent surface impedance, $$Z_s = \frac{E_{tan}}{H_{tan}}$$

(where $E_{tan}$ is the tangential electric field and $H_{tan}$ is tangential magnetic field), approximates an open circuit. The surface impedance inhibits the flow of equivalent tangential electric surface current and thereby approximates a zero tangential magnetic field, $H_{tan} \approx 0$.

One of the main reasons that high-impedance surfaces are useful is because they offer boundary conditions that permit wire antennas (electric currents) to be well matched and to radiate efficiently when the wires are placed in very close proximity to this surface. Typically, antennas are disposed less than $\lambda/100$ from the high-impedance surfaces (usually more like $\lambda/200$), where $\lambda$ is the wavelength of operation. The radiation pattern from the antenna on a high-impedance surface is substantially confined to the upper half space, and the performance is unaffected even if the high-impedance surface is placed on top of another metal surface. The promise of an electrically-thin, efficient antenna is very appealing for countless wireless device and skin-embedded antenna applications.

One embodiment of a conventional frequency selective surface (FSS) is shown in FIG. 1. The FSS acts like thin high-impedance surface within a particular frequency range, or set of frequency ranges. It is a printed circuit structure, using an electrically-thin, planar, periodic structure, with vertical and horizontal conductors, which can be fabricated using low cost printed circuit technologies. The combination of the FSS with a ground backplane is known as an artificial magnetic conductor (AMC). Near its resonant frequency the AMC approximates an open circuit to a normally incident plane wave and suppresses TE and TM surface waves over the band of frequencies near where it operates as a high-impedance surface.

An antenna, such as bent-wire monopole, may be disposed within close proximity to the surface of the AMC, thus decreasing the overall thickness of the device. Bent-wire monopoles are primarily used as the antenna element that is integrated with an AMC. The bent-wire monopole is simply a thin wire or printed strip located a small fraction of a wavelength about $\lambda/200$ above the AMC surface. The bent-wire monopole is disposed on the AMC surface using a thin layer of low loss dielectric material. Typically, a coaxial connector feeds one end of this strip antenna. The outer conductor of the coaxial connector is soldered to the conducting backplane of the AMC, and the inner conductor extends vertically through the AMC and a thin dielectric layer upon which the monopole is printed or disposed to connect to the monopole. Measurements of one such unloaded antenna including the E-plane and H-plane gain patterns at several L-band frequencies are shown in FIGS. 2(*a*) and 2(*b*), respectively. This AMC antenna included an unloaded 1.64 inch (4.17 cm) long by 0.050 inch (0.127 cm) wide bent-wire monopole mounted on 1.5 inch (3.81 cm) by 2.5 inch (6.35 cm) AMC with a resonant frequency near 1.8 GHz.

However, one drawback of such an antenna is that the monopole must have an electrical length of one-quarter of a wavelength, which makes integration of the AMC antenna into a handheld device more of a challenge as devices decrease in size. To reduce the length of the antenna for a given frequency of operation, an inductor can be placed in series with the monopole near the feed point of the antenna, i.e. where the coaxial connector attaches to the monopole, to reduce the length of the antenna for a given frequency of operation. Either printed inductors, which are integrated with the printed monopole, or chip inductors may be used.

However, inductors have a number of problems. One of these problems includes a large amount of loss in the antenna, which results in a relatively inefficient antenna. The reduction in antenna gain increases the power consumption and decreases the battery life of the device. In addition, chip inductors are relatively expensive and bulky in comparison with the monopole. Examples of the E-plane and H-plane gain patterns at several L-band frequencies of typical chip inductance-loaded antennas are illustrated in FIGS. 3(*a*) and 3(*b*), respectively. This AMC antenna included a 1 inch (2.54 cm) long bent-wire monopole base-loaded with a 7 nH inductor mounted on 1.5 inch (3.81 cm) by 2.5 inch (6.35 cm) AMC with a resonant frequency near 1.8 GHz. Although the length of the antenna has been reduced to 60% of its original size by inductive loading, the gain has been reduced between a minimum of about 1.5 dB to a maximum of about 8 dB, depending on the frequency and principal plane, as compared with an unloaded antenna. In general, however, the loss when inserting the inductor may be limited to 1–3 dB. These correspond to efficiencies of from 70% to 16% compared to that of an unloaded antenna. One factor that results in the reduction in efficiency is the windings of the chip inductor, which contribute dissipative loss. Another factor that degrades the antenna efficiency is the mismatch between the impedance of the antenna and that of the inductor. The fabrication of a reduced-size, non-inductively loaded antenna having high efficiency would be of great value.

BRIEF SUMMARY

To reduce the length of an antenna element, such as a bent-wire monopole, relative to an unloaded antenna, increase the radiation efficiency and battery life in portable devices, and fabricate low cost antennas, one embodiment of the antenna comprises an artificial magnetic conductor (AMC), an antenna element disposed on the AMC and having a feed, and a capacitive load separated from the feed and connected with the antenna element.

The capacitive load may be disposed at an end of the antenna element and may be any of: a lumped capacitive load, a distributed capacitive load, a surface mounted capacitive load or a capacitive patch (part of a printed trace or separate metal). The capacitance may have a fixed value or be variable. The reduction in gain between an antenna element without the capacitive load and with the capacitive load may be at most 5 dB. If the capacitive load is lumped, the lumped capacitive load may be connected with an RF backplane of the AMC through a dedicated connection to the backplane or to at least one grounded conductive portion of the FSS that is contained within the AMC.

The capacitive load may form a capacitance between the antenna element and the backplane or between the antenna element and a grounded conductive portion of the FSS. The capacitive load may be in excess of that of the per unit length capacitance of the antenna element.

DETAILED DESCRIPTION OF PREFERRED EMBODIMENTS

A separate capacitive load, as opposed to the intrinsic capacitance associated with an artificial magnetic conductor (AMC), may be added to the AMC. Multiple benefits that result include the ability to reduce the antenna element length relative to an unloaded antenna, thereby decreasing the overall size of the antenna. In addition, the radiation efficiency is increased, thereby leading to an increase in battery life for portable devices that use the capacitively loaded antennas. Further, the present invention permits such antennas to be fabricated using high-volume techniques and enable low cost antennas to be produced.

Figure 4A:
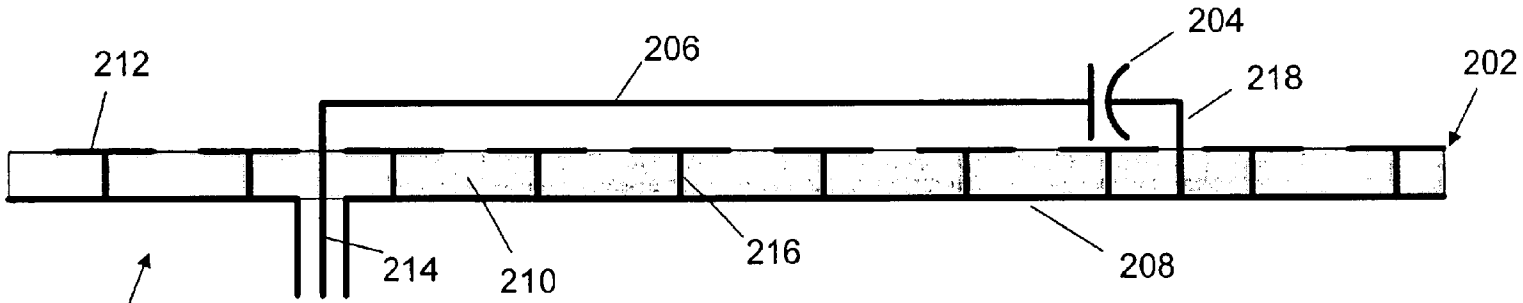
FIGS. 4(*a*) and 4(*b*) show the side views of embodiments of a capacitively-loaded AMC antenna with a single layer and multiple layer FSS.
Figure 4B:
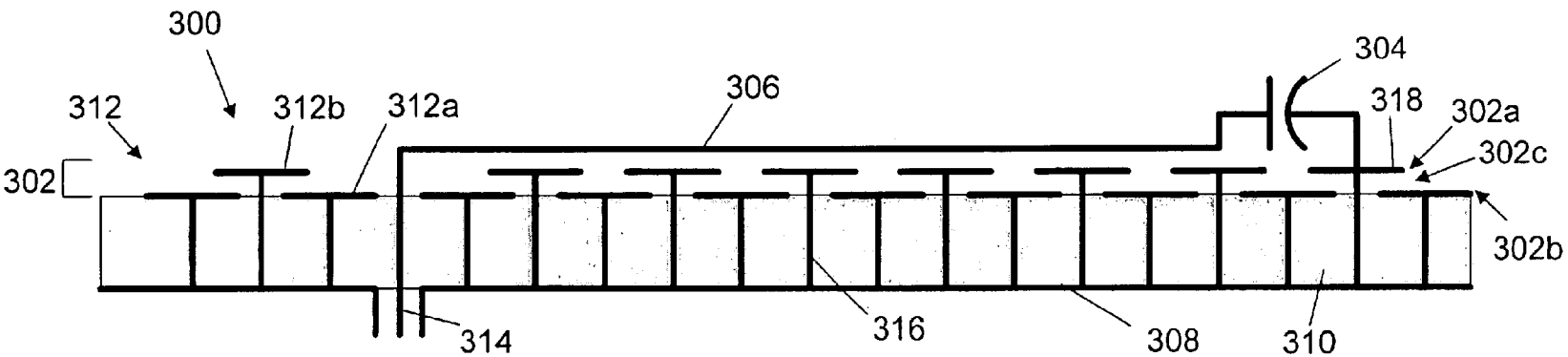
Figure 5A:
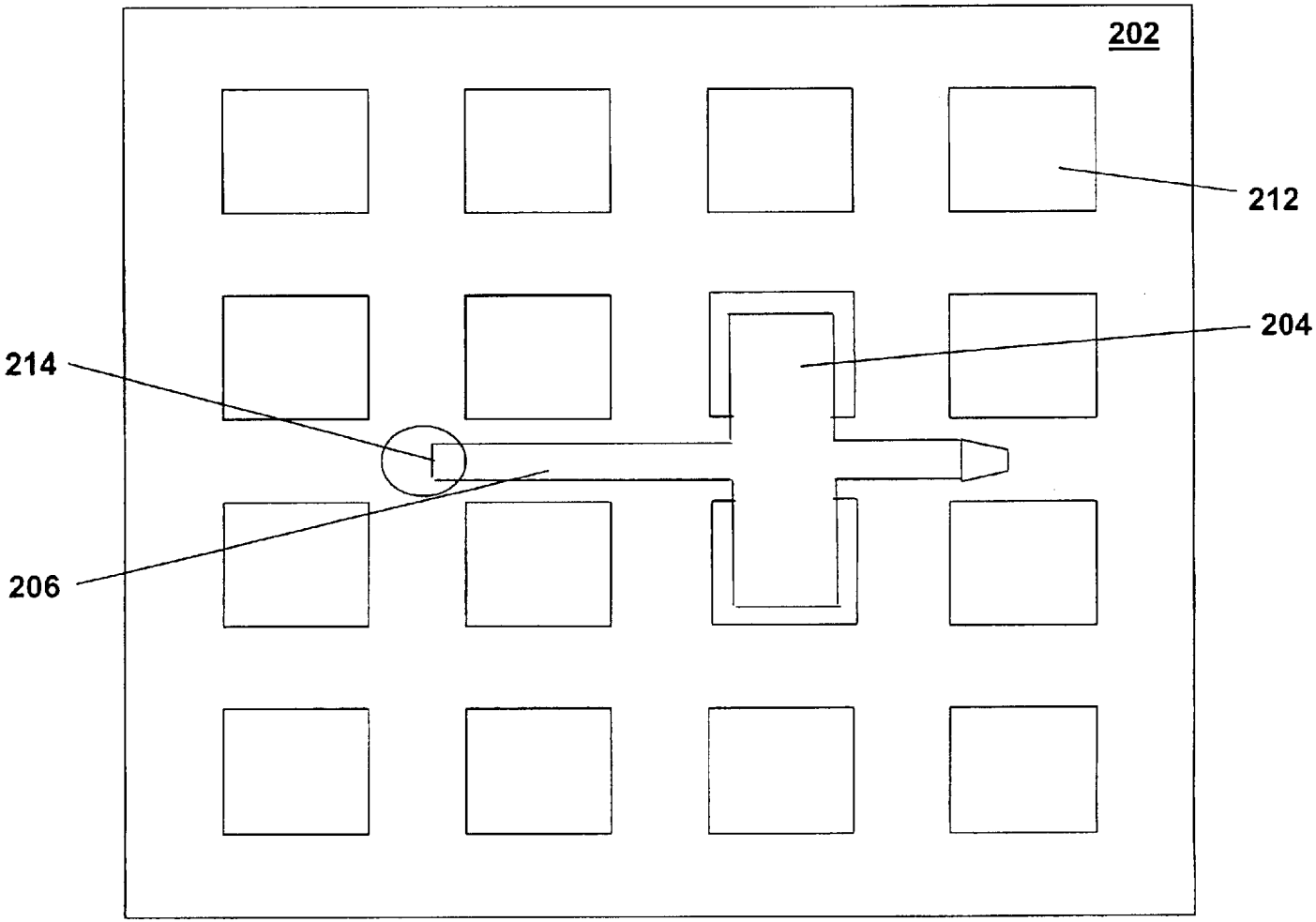
FIGS. 5(*a*) and 5(*b*) show the top views of embodiments of a capacitively-loaded AMC antenna with a single layer and multiple layer FSS.
Figure 5B:
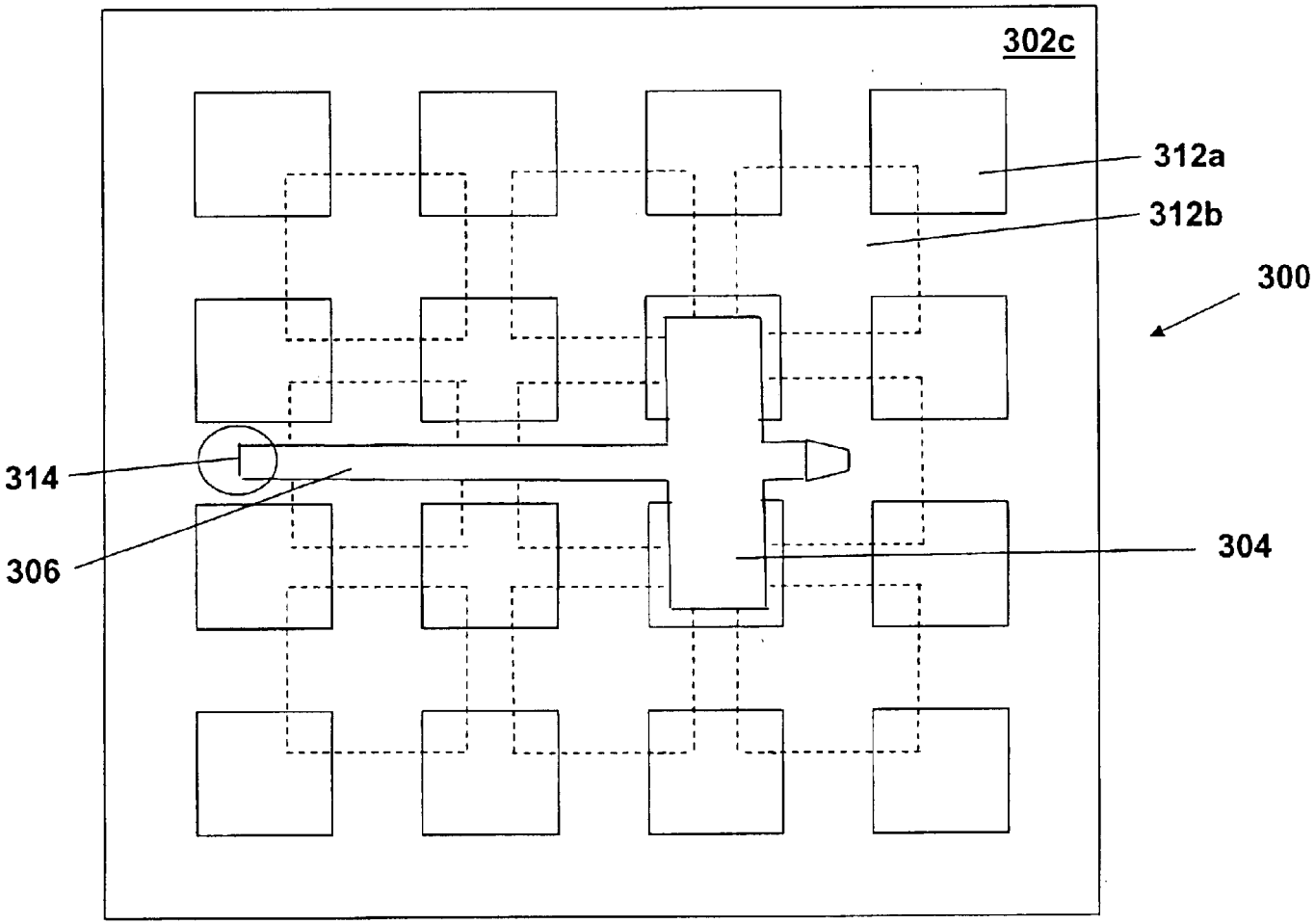

An artificial magnetic conductor (AMC) includes an electrically-thin, periodic structure known as a frequency selective surface (FSS), which may be a printed circuit board. The FSS 202 and 302 may be a multi-layer structure 302, as shown in FIGS. 4(*a*) and 5(*a*) or merely a single layer of metal 202 etched on a dielectric layer as shown in FIGS. 4(*b*) and 5(*b*). In both the single and multi-layer structures, the FSS 202 and 302 has a periodic structure of conductive portions 212 and 312, such as patches, that are close enough to be capacitively coupled with each other. The conductive patches 212 and 312 are formed from any conductive material, typically a metal such as copper or aluminum. The dielectric layer 210 and 310 on which the antenna element 206 and 306 resides may be any conventional insulating material, for example, FR4, polyimide or any other comparable material.

This periodic structure of conductive patches 212 and 312 that forms the FSS 202 and 302 is parallel and electrically close to a simple metal plane 208 and 308 that may be grounded, also called a RF (radio frequency) backplane. The FSS 202 and 302 is separated from the conductive RF backplane 208 and 308 of the AMC 200 and 300 by a dielectric layer 210 and 310, which is usually a solid dielectric but may also be an air layer. The conductive patches 212 and 312 are connected with the backplane 208 and 308 through vias 216 and 316. The vias 216 and 316 may be fabricated in the solid dielectric 210 and 310 by methods such as plating, deposition or sputtering, or may be a rodded media that is formed by stamping. The high impedance surface is the FSS side of the AMC 200 and 300.

In the multi-layer structure 302, a second layer of conductive patches 302*b* is separated from the first layer of conductive patches 302*a* by a second dielectric layer 302*c*. The patches of the second layer 312*b* overlap the patches of the first layer 312*a*, thereby creating a significant parallel plate capacitance in addition to the edge-to-edge capacitance formed between the patches on each layer. The conductive patches of the second layer 312*b* may be formed from either the same conductive material as that of the conductive patches of the first layer 312*a* or different conductive material. Similarly, the second dielectric layer 302*c* may be formed from the same insulating material as that of the first dielectric layer 310 on which the first layer of conductive patches 302*a* are disposed or different insulating material with a different dielectric constant. In one example, the AMC 300 with the multi-layer FSS 302 comprises a printed circuit board in which each pair of the dielectric layers 302*c* and 310 and the layers of conductive patches 302*a* and 302*b* are formed from the same material. The conductive patches of the second layer 302*b* may be grounded to the backplane 308 through vias 316 as shown in FIG. 4(*b*) or may be isolated from the backplane 308 and from the conductive patches of the first layer (not shown). In one example of such a multi-layer structure, the period of the capacitive patches 302*a* and 302*b* may be 250 mils, the first dielectric layer 310 may be FR4 ($\epsilon_r$~4.5) having a thickness of 62 mil and the second dielectric layer 302*c* may be polyimide ($\epsilon_r$~3.5) having a thickness of 2 mil.

The FSS may be either a simple constant capacitance FSS, or a more complex FSS whose effective transverse permittivity contains Lorentz poles, as described in patent application Ser. No. 09/678,128 entitled "Multi-Resonant High-Impedance Electromagnetic Surfaces" filed on Oct. 4, 2001 in the names of Rudolfo E. Diaz and William E. McKinzie III and commonly assigned to the assignee of the present application, which is incorporated herein in its entirety by this reference. A non-harmonically linked multi-resonant FSS may include specific inductances and designs to adjust the resonant frequencies. Examples include adding chip inductors to either layer, forming the conductive patches with notches or adding an in-plane grid in either layer or out-of-plane grid on a third layer. These arrangements modify the equivalent circuit by adding new inductances to a particular leg or creating a new parallel leg, thereby adjusting the AMC resonant frequency or frequencies.

However, while the use of printed or chip inductors in the FSS may be desirable, the introduction of these inductors near the feed point (feed) of the antenna element to reduce the length of the antenna element for a given frequency of operation is not attractive. Although a series inductor is useful to improve the antenna's impedance match, the inductor also reduces the efficiency of the antenna through dissipative loss. In addition, chip inductors in particular are relatively expensive compared to other components, such as printed or chip capacitors. Thus, to reduce the length of an antenna element, such as a bent-wire monopole that is disposed on the AMC, a capacitance must be established between the bent-wire monopole and ground that is in excess of that of the per unit length capacitance of the bent-wire monopole. This capacitance is disposed more distal to a feed of the bent-wire monopole than an opposing end of the bent-wire monopole.

In one embodiment, shown in FIG. 4(*a*), an antenna has an antenna element 206, such as a thin strip bent-wire monopole 206, mounted over the AMC 200. A feed 214, which feeds input signals near the resonant frequency of the AMC 200 to the bent-wire monopole 206, is disposed at one end of the bent-wire monopole 206. The end of the bent-wire monopole 206 opposite to the feed 214 is loaded with a distributed or lumped capacitive element 204. The addition of the capacitive element 204 to the antenna element 206 reduces the required length of the antenna element 206. Although the physical length of the antenna element 206 may be smaller, the electrical length of the antenna element 206 appears to be one-quarter of a wavelength to the input signal. Thus, a physically small antenna may be produced for a given frequency of operation without suffering a substantial loss of efficiency. The antenna is separated an effective distance from the surface of the AMC 200, usually by another dielectric layer (not shown), such that it couples electromagnetically with the surface of the AMC 200.

The capacitive elements 204 may have different characteristics. For example, either a distributed or lumped capacitive element may be supplied at the end of the bent-wire monopole 206 opposite to the feed 214. Such capacitors may have a fixed or variable capacitance and may be discrete surface mounted components or printed traces. In embodiments containing a lumped capacitor, for example, the grounded side of the lumped capacitor may be connected directly to the conductive RF backplane 208 of the AMC 200 using a dedicated via 218 or may be connected to one of the conductive patches 318 in the capacitive FSS 302 that is in turn connected with the grounded backplane 308, as illustrated in FIGS. 4(*b*) and 5(*b*). A simple metal electrode having an area substantially larger than that of the antenna element 206 and 306 may be used to create capacitance between the electrode and the conductive patches 212 and 312 of the FSS 202 and 302. One example of such an arrangement may use copper tape as the electrode.

Figure 1:
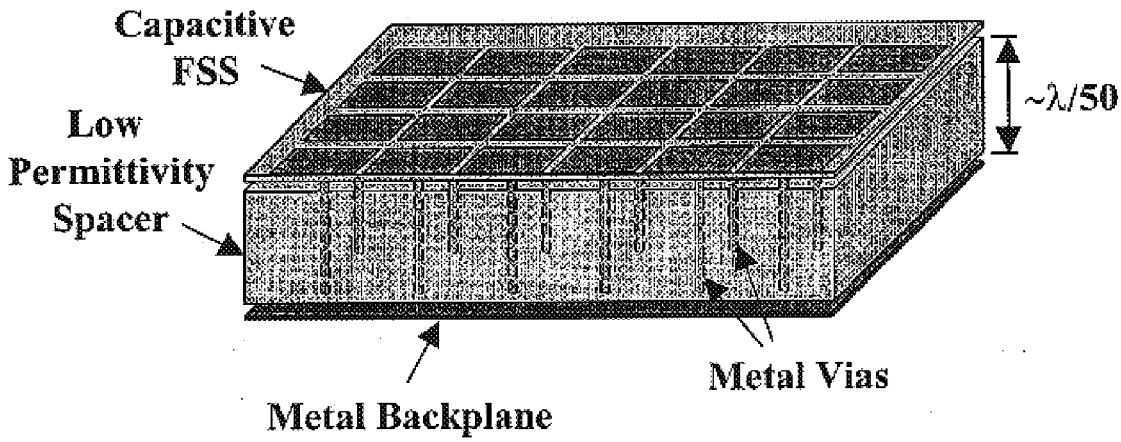
FIG. 1 illustrates a conventional artificial magnetic conductor (AMC)
Figure 2A:
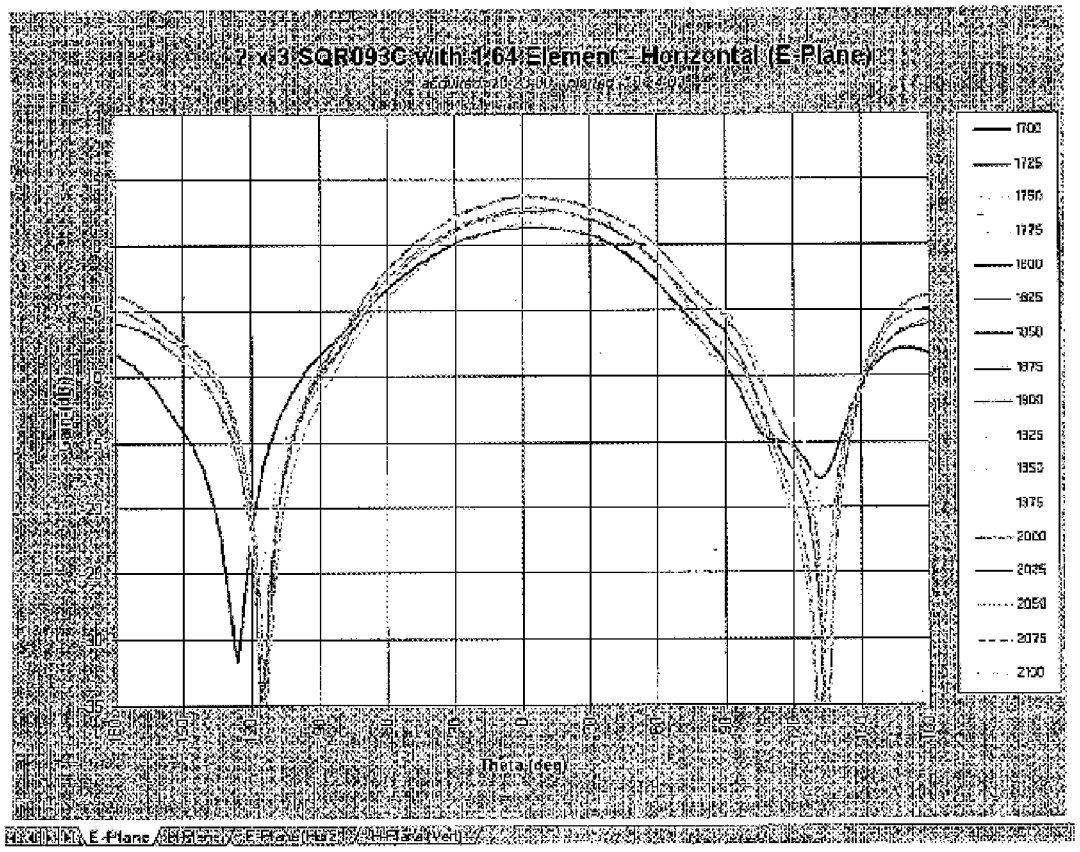
FIGS. 2(*a*) and 2(*b*) show the E-plane and H-plane gain patterns at several L-band frequencies of a conventional unloaded AMC antenna.
Figure 2B:
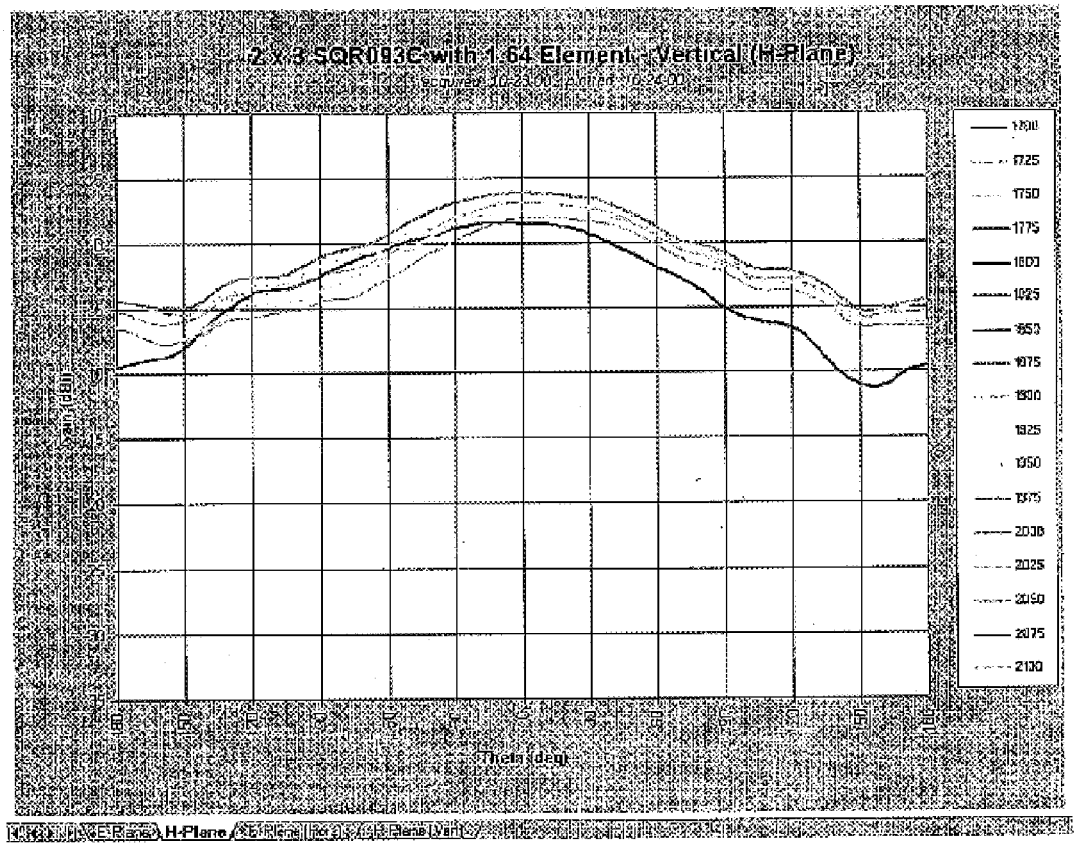
Figure 3A:
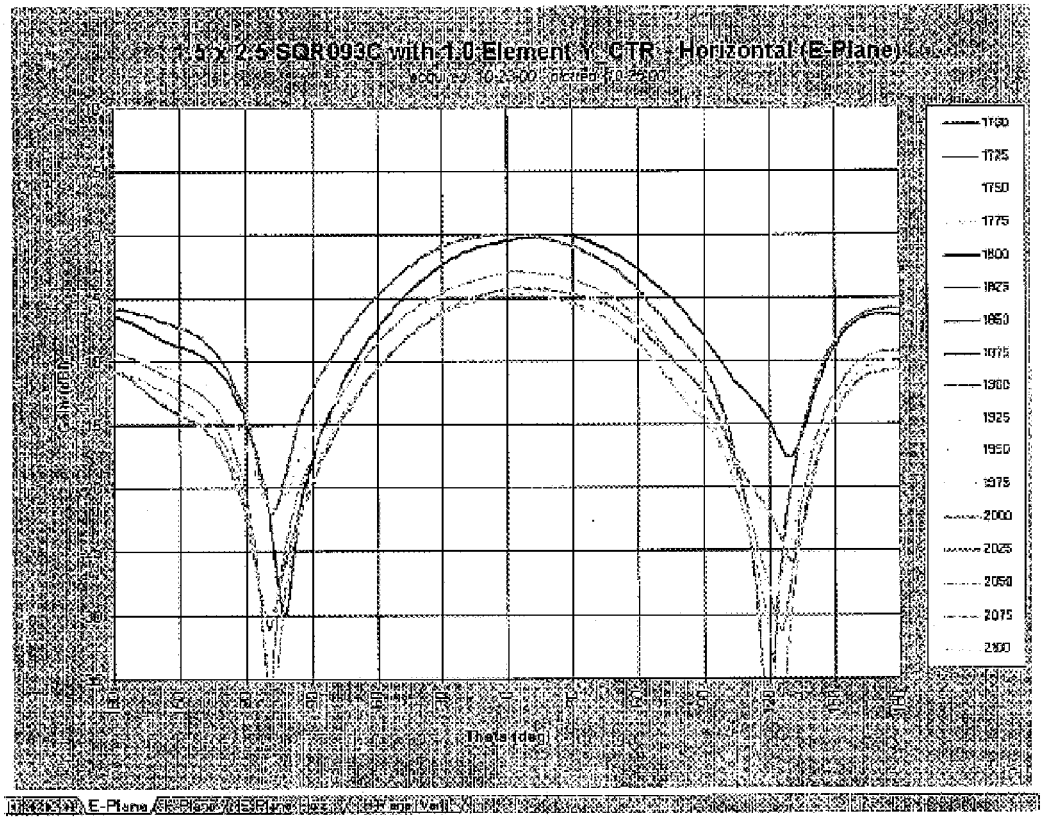
FIGS. 3(*a*) and 3(*b*) show the E-plane and H-plane gain patterns at several L-band frequencies of a conventional inductively-loaded AMC antenna.
Figure 3B:
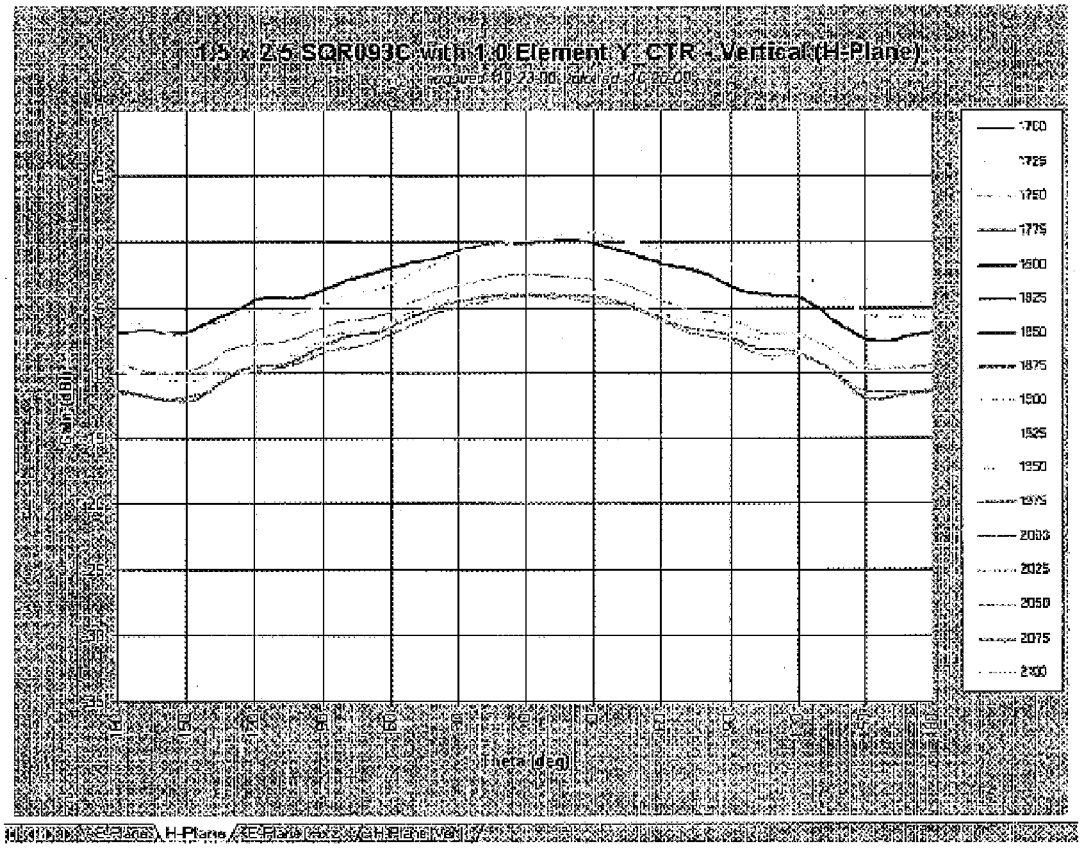
Figure 6A:
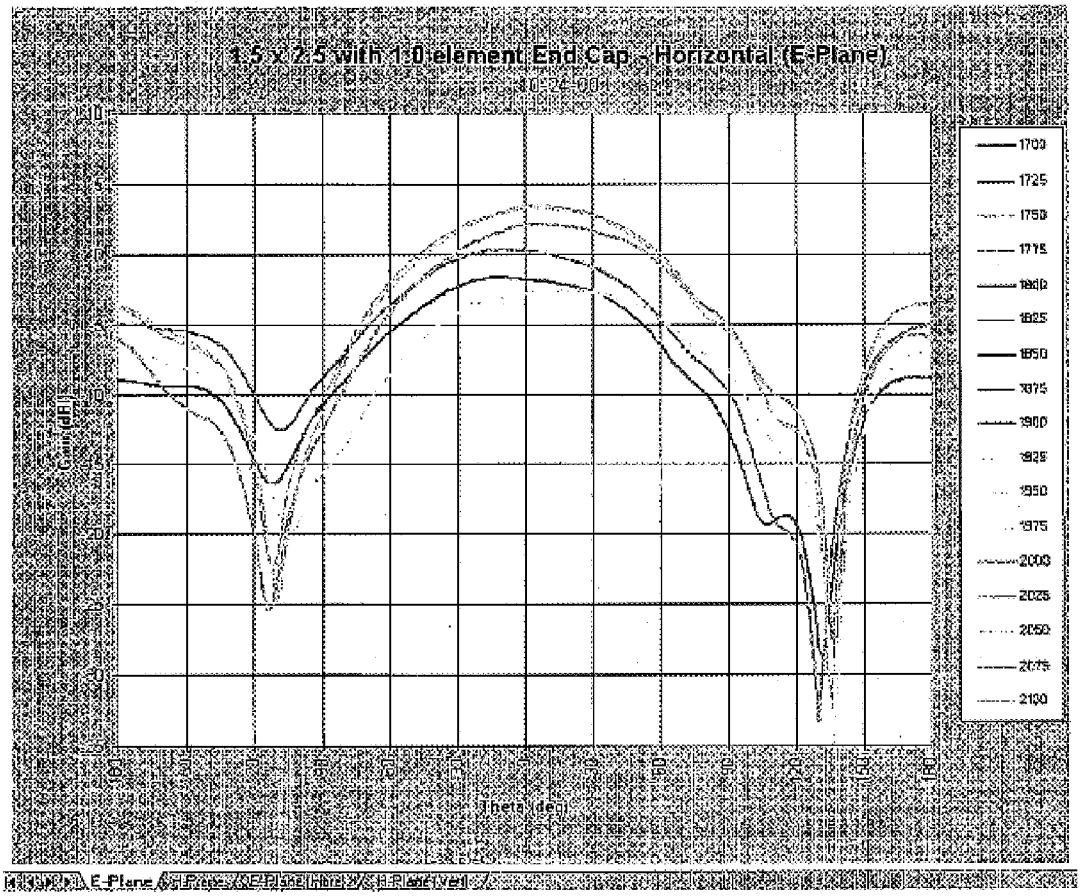
FIGS. 6(*a*) and 6(*b*) show the E-plane and H-plane gain patterns at several L-band frequencies of one embodiment of a capacitively-loaded AMC antenna.
Figure 6B:
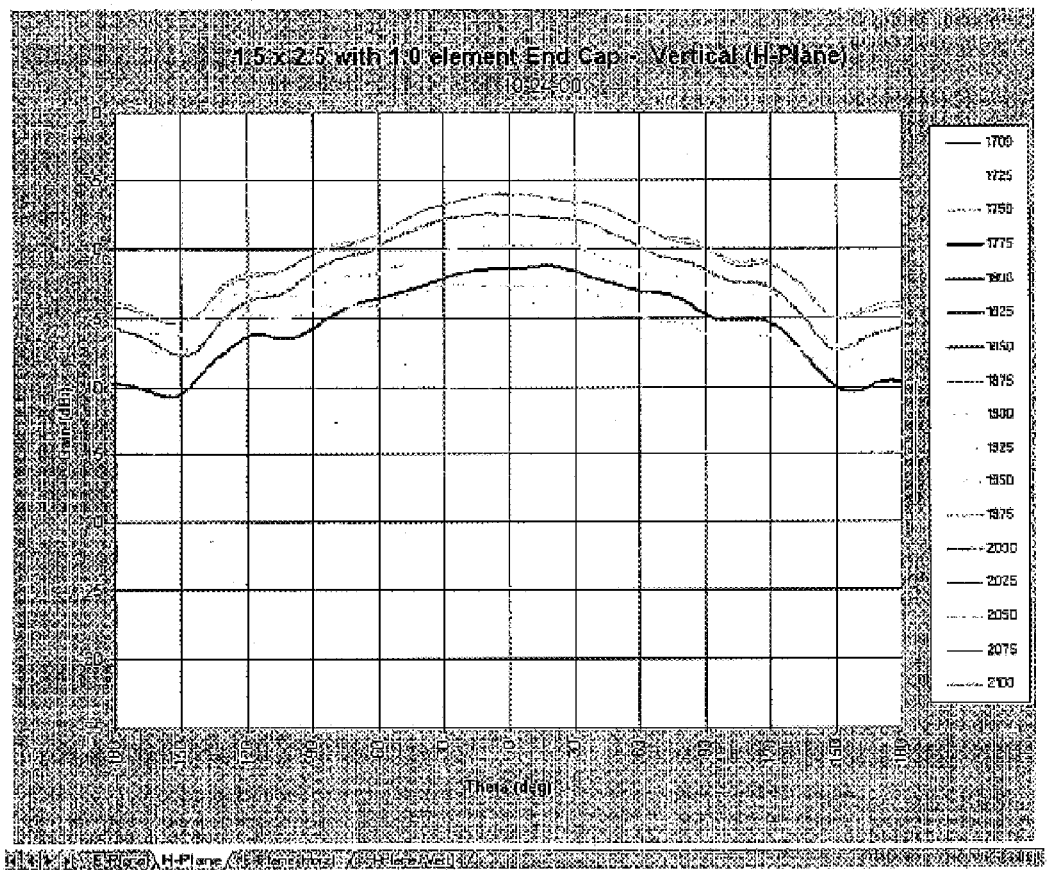

Gain measurements of one example of an antenna comprising a bent-wire monopole loaded by a discrete, lumped, surface-mounted capacitor at the end of the bent-wire monopole opposite to the feed are shown in FIGS. 6(*a*) and 6(*b*). In this example, the bent-wire monopole was 1.0 inch (2.54 cm) in length and mounted on a 1.5 inch (3.81 cm) by 2.5 inch (6.35 cm) AMC that resonates at about 1.8 GHz. A discrete capacitor with a variable capacitance was used to allow the resonant frequency of the antenna to be tuned. For personal communication system (PCS) band frequencies in the range of about 1.85 GHz to about 1.99 GHz, a capacitance of between about 1 and 2.5 pF appears to work well. The measurements included the E-plane and H-plane gain patterns at several L-band frequencies, shown in FIG. 6(*a*) and FIG. 6(*b*), respectively. Although some reduction in gain existed relative to the measurements on unloaded antenna as shown in FIGS. 2(*a*) and 2(*b*), at certain frequencies with the introduction of the capacitive loading, the degradation in antenna gain due to the capacitive loading is generally much less than that observed with inductive loading shown in FIGS. 3(*a*) and 3(*b*). The maximum reduction in gain observed with capacitive loading is about 5 dB, which compares favorably with the maximum reduction in gain observed with inductive loading of about 8 dB. Note that although all of the results are for AMC antennas with a resonant frequency of near 1.8 GHz, the AMC may also be used for any frequency range desired including both the 800 MHz range and Bluetooth range of about 2.4 GHz.

Figures 7, 7B, 7E:
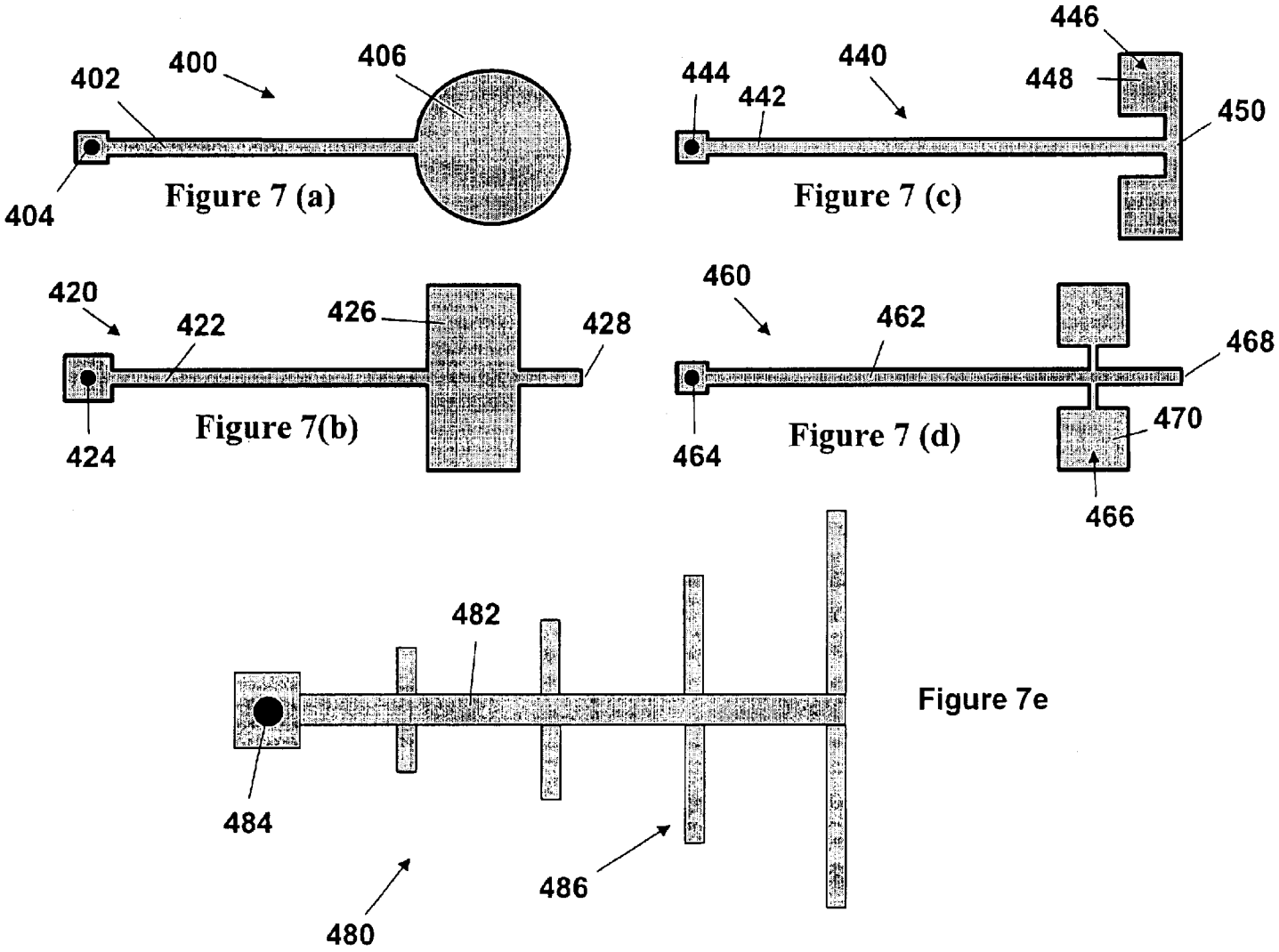
FIGS. 7(*a*)–7(*e*) illustrate different embodiments of printed capactive loading of a capacitively-loaded AMC antenna.

As above, the use of discrete capacitors is not the only way to fabricate a capacitively-loaded bent-wire monopole. Coplanar distributed and lumped capacitive elements may also be used. Examples of such coplanar capacitive elements include printed patches, printed traces or copper tape and antennas with these capacitive elements are illustrated in FIGS. 7(*a*)–(*e*). In one example, FIG. 7(*a*) illustrates an antenna 400 that includes an antenna element 402, a feed 404 and a capacitive element 406 symmetrically disposed around an end of the antenna element 402 distal to the feed 404. Similarly, in FIG. 7(*c*) the antenna 440 is formed in a "T" shape and includes an antenna element 442, a feed 444, and a capacitive element 446 formed from a pair of square capacitive elements 448 that are symmetrically disposed around an end 450 of the antenna element 442 distal to the feed 444. One advantage of using these types of capacitors rather than a discrete capacitor is a reduction in manufacturing time and cost. For example, a coplanar printed patch may be etched on the same layer as the conventional bent-wire monopole. This also has the beneficial effect of reducing the profile in height (thickness) of the overall antenna.

The printed patches, printed traces or copper tape, all of which may be used to manifest the capacitance, do not necessarily have to be located at the open end of the bent-wire monopole. Rather, the capacitance may be distributed along the antenna element, as illustrated in FIGS. 7(*b*) and 7(*d*), adding a parallel plate capacitance to ground. In FIG. 7(*b*), the antenna 420 includes an antenna element 422, a feed 424, and a simple rectangular capacitive element 426 symmetrically disposed around the antenna element 422, more distal to the feed 424 than to an end of the antenna element 422 opposing the feed 424. Similarly, in FIG. 7(*d*), the antenna 460 includes an antenna element 462, a feed 464, and a capacitive element 466 formed from a pair of square capacitive elements 470 that are symmetrically disposed around the antenna element 462. As above, the capacitive element 466 is more distal to the feed 464 than to an end of the antenna element 462 opposing the feed 464. In addition, as shown in FIG. 7(*e*), these designs may be combined so that the antenna 480 includes multiple capacitive elements 486 of various sizes disposed at different locations along the antenna element 482 distal to the feed 484.

Although the capacitive element may be disposed at any point along the antenna element, the best impedance match has been determined for antennas in which the capacitive load is disposed as far distal from, i.e. at the opposite end of, the antenna element as the feed. The improvement in impedance match affords a higher gain and more efficient antenna. Note that it is the surface area of the capacitive element coupled with the thickness and permittivity of the dielectric layer upon which the monopole is printed that defines the amount of end loading necessary. Thus, while there are almost an infinite variety of possible shapes and distributions of capacitive elements to achieve a particular amount of capacitance, a simple square printed trace or portion of metal may be all that is needed. In addition, an AMC antenna with a bent-wire monopole may be end-loaded with a wire trim capacitor realized as a twisted pair. This wire trim capacitor may substitute for or be used in addition to a capacitive patch.

Antennas that include the antenna element and AMC embodiments above have application to wireless handsets where aperture size and weight need to be minimized, as well as the absorption of radiated power by the human body is to be minimized. These embodiments also result in easier integration of the antenna into portable devices, such as handheld wireless devices, greater radiation efficiency than other loaded antenna approaches, longer battery life in portable devices, and lower cost than use of a chip inductor. Potential applications include handset antennas for mobile and cordless phones, wireless personal digital assistant (PDA) antennas, precision GPS antennas, and Bluetooth radio antennas.

While the invention has been described with reference to specific embodiments, the description is illustrative of the invention and not to be construed as limiting the invention. Various modifications and applications may occur to those skilled in the art without departing from the true spirit and scope of the invention as defined in the appended claims.

We claim:

1. An antenna comprising:

an artificial magnetic conductor (AMC);

an antenna element disposed on the AMC, the antenna element having a feed; and a capacitive load connected with the antenna element, the capacitive load separated from the feed.

2. The antenna of claim 1, wherein the feed is disposed at a first end of the antenna element.

3. The antenna of claim 2, wherein the capacitive load is disposed at a second end of the antenna element.

4. The antenna of claim 1, wherein the capacitive load is disposed at an end of the antenna element.

5. The antenna of claim 1, wherein the capacitive load comprises a lumped capacitive load.

6. The antenna of claim 5, the AMC comprising an RF backplane and a frequency selective surface (FSS) having conductive patches, wherein the lumped capacitive load is connected with the RF backplane through a dedicated connection to the RF backplane.

7. The antenna of claim 5, the AMC comprising an RF backplane and a frequency selective surface (FSS) having conductive patches, wherein at least one of the conductive patches is connected with the RF backplane and the lumped capacitive load is connected with the RF backplane through the at least one of the conductive patches.

8. The antenna of claim 1, wherein the capacitive load comprises a distributed capacitive load.

9. The antenna of claim 1, wherein the capacitive load has a fixed capacitance.

10. The antenna of claim 1, wherein the capacitive load has a variable capacitance.

11. The antenna of claim 1, wherein the capacitive load comprises a surface mounted capacitive load.

12. The antenna of claim 1, wherein the capacitive load comprises a printed trace.

13. The antenna of claim 12, wherein the printed trace comprises a capacitive patch.

14. The antenna of claim 1, wherein the antenna element comprises a bent-wire monopole.

15. The antenna of claim 1, wherein a reduction in gain between an antenna element without the capacitive load and with the capacitive load is at most 5 dB.

16. The antenna of claim 1, wherein the capacitive load is coplanar with the antenna element.

17. The antenna of claim 16, wherein the capacitive load is a capacitive patch.

18. The antenna of claim 17, wherein the feed is disposed at a first end of the antenna element.

19. The antenna of claim 18, wherein the capacitive patch is disposed at a second end of the antenna element.

20. The antenna of claim 17, wherein the capacitive patch is disposed at an end of the antenna element.

21. The antenna of claim 16, wherein the capacitive load further comprises a wire trim capacitor.

22. The antenna of claim 1, wherein the AMC comprises an RF backplane and a frequency selective surface (FSS) having conductive patches, and the capacitive load forms a capacitance between the antenna element and the backplane.

23. The antenna of claim 1, wherein the AMC comprises an RF backplane and a frequency selective surface (FSS) having conductive patches, and the capacitive load forms a capacitance between the antenna element and at least one of the conductive patches.

24. The antenna of claim 23, wherein the at least one of the conductive patches is grounded.

25. An antenna comprising:

an artificial magnetic conductor (AMC) including an RF backplane and a frequency selective surface (FSS) having conductive patches, at least one of the patches being conductively connected to the RF backplane;

an insulating layer disposed on the AMC;

a bent-wire monopole disposed on the insulating layer, the bent-wire monopole having a feed at a first end; and a capacitive load connected with the bent-wire monopole, the capacitive load separated from the feed.

26. The antenna of claim 25, wherein the capacitive load is disposed at a second end of the antenna element.

27. The antenna of claim 25, wherein the capacitive load is disposed at an end of the antenna element.

28. The antenna of claim 25, wherein the capacitive load comprises a lumped capacitive load connected with the RF backplane through a dedicated connection to the backplane.

29. The antenna of claim 25, wherein the capacitive load comprises a lumped capacitive load connected with the RF backplane through the at least one of the conductive patches.

30. The antenna of claim 25, wherein the capacitive load comprises a distributed capacitive load.

31. The antenna of claim 25, wherein the capacitive load has a fixed capacitance.

32. The antenna of claim 25, wherein the capacitive load has a variable capacitance.

33. The antenna of claim 25, wherein the capacitive load comprises a surface mounted capacitive load.

34. The antenna of claim 25, wherein the capacitive load comprises a printed trace.

35. The antenna of claim 34, wherein the printed trace comprises a capacitive patch.

36. The antenna of claim 25, wherein a reduction in gain between a bent-wire monopole without the capacitive load and with the capacitive load is at most 5 dB.

37. The antenna of claim 25, wherein the capacitive load is coplanar with the antenna element.

38. The antenna of claim 25, wherein the capacitive load is a capacitive patch.

39. The antenna of claim 38, wherein the capacitive patch is disposed at a second end of the antenna element.

40. The antenna of claim 25, wherein the capacitive load further comprises a wire trim capacitor.

41. The antenna of claim 25, wherein the capacitive load forms a capacitance between the bent-wire monopole and the backplane.

42. The antenna of claim 25, wherein the capacitive load forms a capacitance between the bent-wire monopole and at least one of the conductive patches of the FSS.

43. The antenna of claim 42, wherein the at least one of the conductive patches is grounded.

44. A method of reducing a length of a bent-wire monopole disposed on an artificial magnetic conductor (AMC), the method comprising establishing a capacitance in excess of that of a per unit length capacitance of the bent-wire monopole between the bent-wire monopole and ground and establishing that the capacitance is disposed more distal to a feed of the bent-wire monopole than to an opposing end of the bent-wire monopole.

45. The method of claim 44, further comprising establishing the capacitance between the bent-wire monopole and grounded conductive patches of the AMC.

46. The method of claim 44, further comprising feeding a signal to the feed of the bent-wire monopole at a first end of the bent-wire monopole.

47. The method of claim 46, further comprising establishing the capacitance at a second end of the antenna element.

48. The method of claim 44, further comprising establishing the capacitance at an end of the antenna element.

49. The method of claim 44, further comprising connecting a lumped capacitive load forming the capacitance with ground through a dedicated connection.

50. The method of claim 44, further comprising connecting a lumped capacitive load forming the capacitance with ground through at least one conductive patch of the AMC.

51. The method of claim 44, further comprising distributing the capacitance along the bent-wire monopole.

52. The method of claim 44, further comprising permanently fixing the capacitance to a predetermined value.

53. The method of claim 44, further comprising varying the capacitance within a preset range of values.

54. The method of claim 44, further comprising surface mounting the capacitance on a layer on which the bent-wire monopole is mounted.

* * * * *